US012055290B2

(12) United States Patent
Pye

(10) Patent No.: US 12,055,290 B2
(45) Date of Patent: Aug. 6, 2024

(54) ON DEMAND SPARK PLUME GENERATOR TO IGNITE FLAMMABLE GASSES

(71) Applicant: SAUDI ARABIAN OIL COMPANY, Dhahran (SA)

(72) Inventor: Richard Mark Pye, Aberdeen (GB)

(73) Assignee: Saudi Arabian Oil Company, Dhahran (SA)

( * ) Notice: Subject to any disclaimer, the term of this patent is extended or adjusted under 35 U.S.C. 154(b) by 436 days.

(21) Appl. No.: 17/457,813

(22) Filed: Dec. 6, 2021

(65) Prior Publication Data

US 2023/0175690 A1 Jun. 8, 2023

(51) Int. Cl.

| | |
|---|---|
| ***F23Q 1/02*** | (2006.01) |
| ***E21B 41/00*** | (2006.01) |
| ***F23G 7/08*** | (2006.01) |

(52) U.S. Cl.

CPC ..... *F23G 7/08* (2013.01); *E21B 41/0071* (2013.01); *F23Q 1/02* (2013.01)

(58) Field of Classification Search

CPC ..... F23G 7/08; E21B 41/0071; F23Q 1/02
USPC ..... 431/5
See application file for complete search history.

(56) References Cited

U.S. PATENT DOCUMENTS 2,224,406 A * 12/1940 Mitton ..... F23Q 2/46 431/143
3,420,759 A * 1/1969 Kiyoshi ..... B23H 5/02 219/68
3,756,765 A 9/1973 Sparrow et al.
4,431,402 A * 2/1984 Hamilton ..... E21B 41/0071 431/23
2005/0181320 A1 8/2005 Vitantonio et al.
(Continued)

FOREIGN PATENT DOCUMENTS

| | | |
|---|---|---|
| CN | 2729303 Y | 9/2005 |
| CN | 201081247 Y | 7/2008 |
| CN | 201145290 Y | 11/2008 |

(Continued)

OTHER PUBLICATIONS

Notification of Transmittal of the International Seach Report and the Written Opinion of the International Searching Authority issued in corresponding International Application No. PCT/US2022/052024, mailed Mar. 13, 2023 (13 pages).

*Primary Examiner* — Avinash A Savani
(74) *Attorney, Agent, or Firm* — Osha Bergman Watanabe & Burton LLP

(57) ABSTRACT

A system for a spark plume generator system for igniting flammable gases at a drilling rig includes a support disposed within a fireproof housing proximate to the drilling rig. A grinder is mounted on the support. The grinder includes a rotatable grinder axle with an abrasive grinder surface and an igniter mounted on the support so as to cooperatively contact the grinder. The igniter includes an igniter surface that creates sparks when abraded. The fireproof housing includes an opening. Upon rotation of the grinder axle, the grinder surface abrades the igniter surface to create sparks. The support is positioned within the fireproof housing so that sparks created by the igniter surface exit the fireproof housing through the opening. The fireproof housing is positioned such that the opening is facing the drilling rig and sparks exiting the opening will ignite any flammable gases at the drilling rig.

27 Claims, 8 Drawing Sheets

(56) References Cited

U.S. PATENT DOCUMENTS

2012/0308940 A1 12/2012 Caso

FOREIGN PATENT DOCUMENTS

| | | | |
|---|---|---|---|
| CN | 101761321 | A | 6/2010 |
| CN | 201513922 | U | 6/2010 |
| CN | 203549898 | U | 4/2014 |
| CN | 203656943 | U | 6/2014 |
| CN | 208418804 | U | 1/2019 |
| WO | 94/29648 | A1 | 12/1994 |

* cited by examiner

ON DEMAND SPARK PLUME GENERATOR TO IGNITE FLAMMABLE GASSES

BACKGROUND

The disclosure relates generally to production of fluid from subterranean reservoirs. Fluids are typically produced from a reservoir in a subterranean formation by drilling a wellbore into the subterranean formation, establishing a flow path between the reservoir and the wellbore, and conveying the fluids from the reservoir to the surface through the wellbore. Fluids produced from a hydrocarbon reservoir may include natural gas, oil, and water. Oftentimes, non-commercial, undesirable production also accompanies the hydrocarbons. One such undesirable compound is the poisonous formation gas hydrogen sulfide, $H_2S$.

In some situations, formation gases, including $H_2S$, which have precipitated out of solution can be unintentionally released into the atmosphere. This is often called a blowout. The $H_2S$ mixes with air, but the gas is lethal if inhaled in concentrations of 1000 parts per million (ppm), which is possible from the concentrations found in some formations. In some emergency cases, it is desirable to deliberately burn the $H_2S$ rather than allow it to drift to population centers.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments, methods and systems for a spark plume generator system for igniting flammable gases at a drilling rig. The system includes a support disposed within a fireproof housing proximate to the drilling rig. A grinder is mounted on the support. The grinder includes a rotatable grinder axle with an abrasive grinder surface and an igniter mounted on the support so as to cooperatively contact the grinder. The igniter includes an igniter surface that creates sparks when abraded. The fireproof housing includes an opening. Upon rotation of the grinder axle, the grinder surface abrades the igniter surface to create sparks. The support is positioned within the fireproof housing so that sparks created by the igniter surface exit the fireproof housing through the opening. The fireproof housing is positioned such that the opening is facing the drilling rig and sparks exiting the opening will ignite any flammable gases at the drilling rig.

This disclosure presents, in accordance with one or more embodiments, a method for reducing a concentration of $H_2S$ in air proximate a leak of $H_2S$ from subterranean reservoirs. The method includes providing a spark plume generator system for igniting flammable gases at a drilling rig. The system includes a support disposed within a fireproof housing proximate to the drilling rig. A grinder is mounted on the support. The grinder includes a rotatable grinder axle with an abrasive grinder surface and an igniter mounted on the support so as to cooperatively contact the grinder. The igniter includes an igniter surface that creates sparks when abraded. The method also includes disposing an SPG at a wellsite proximate to the drilling rig, connecting the SPG to the drilling rig, and actuating the SPG.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
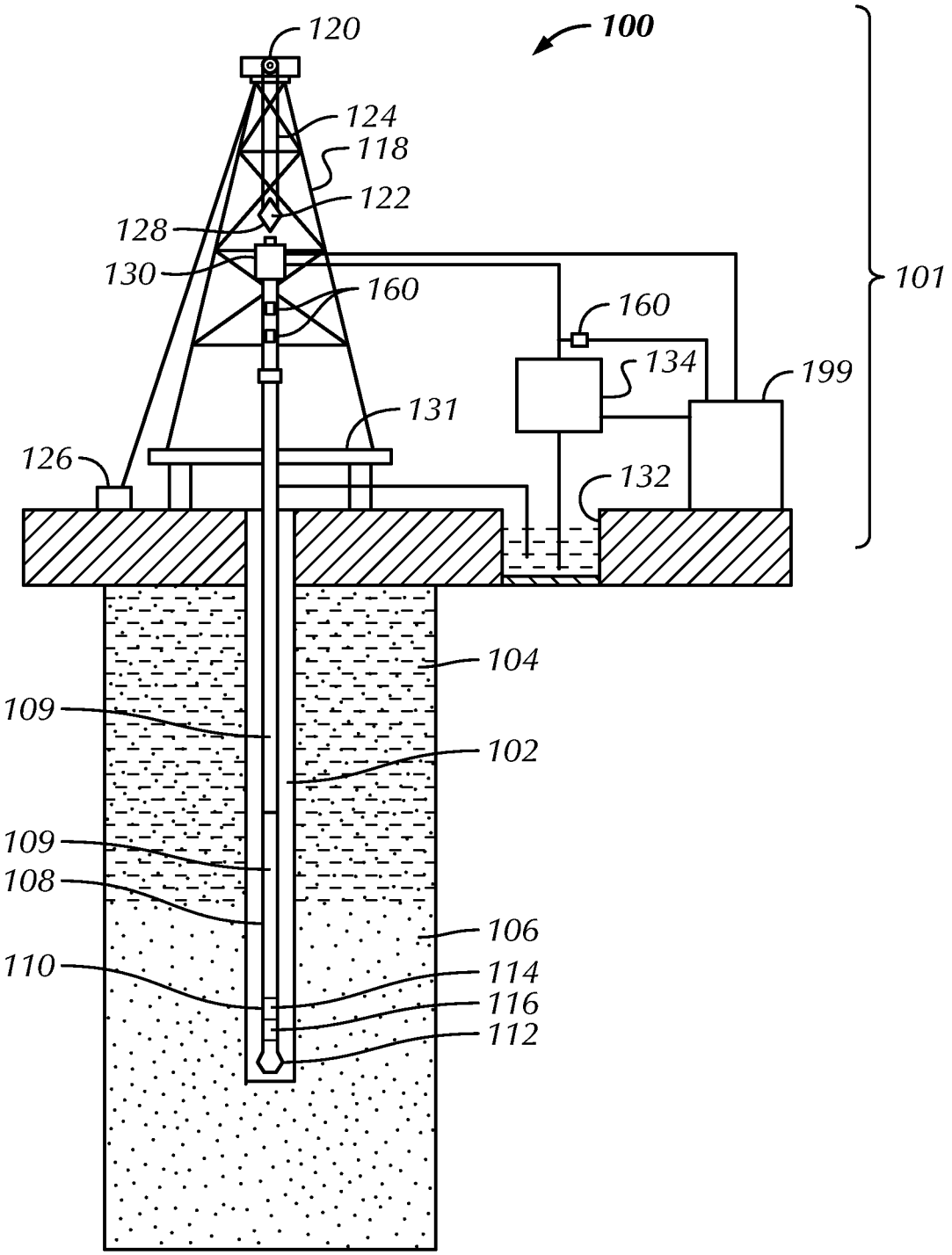
FIG. 1 shows an exemplary wellsite in accordance with one or more embodiments.

FIG. 1 illustrates an exemplary wellsite (100). In general, wellsites may be configured in a myriad of ways. Therefore, wellsite (100) is not intended to be limiting with respect to the particular configuration of the drilling equipment. The particular configuration of the drilling equipment may be named collectively as the drilling rig (101). The wellsite (100) is depicted as being on land. In other examples, the wellsite (100) may be offshore, and drilling may be carried out with or without use of a marine riser. A drilling operation at wellsite (100) may include drilling a wellbore (102) into a subsurface including various formations (104, 106). For the purpose of drilling a new section of wellbore (102), a drill string (108) is suspended within the wellbore (102).

The drill string (108) may include one or more drill pipes (109) connected to form conduit and a bottom hole assembly (BHA) (110) disposed at the distal end of the conduit. The BHA (110) may include a drill bit (112) to cut into the subsurface rock. The BHA (110) may include measurement tools, such as a measurement-while-drilling (MWD) tool (114) and logging-while-drilling (LWD) tool (116). Measurement tools (114, 116) may include sensors and hardware to measure downhole drilling parameters, and these measurements may be transmitted to the surface using any suitable telemetry system known in the art. The BHA (110) and the drill string (108) may include other drilling tools known in the art, but not specifically shown.

The drill string (108) may be suspended in wellbore (102) by a derrick (118). A crown block (120) may be mounted at the top of the derrick (118), and a traveling block (122) may hang down from the crown block (120) by means of a cable or drilling line (124). One end of the cable (124) may be connected to a drawworks (126), which is a reeling device that may be used to adjust the length of the cable (124) so that the traveling block (122) may move up or down the derrick (118). The traveling block (122) may include a hook (128) on which a top drive (130) is supported.

The top drive (130) is coupled to the top of the drill string (108) and is operable to rotate the drill string (108). Alternatively, the drill string (108) may be rotated by means of a rotary table (not shown) on the drilling floor (131). Drilling fluid (commonly called mud) may be stored in a mud pit (132), and at least one pump (134) may pump the mud from the mud pit (132) into the drill string (108). The mud may flow into the drill string (108) through appropriate flow paths in the top drive (130) (or a rotary swivel if a rotary table is used instead of a top drive to rotate the drill string (108)).

In one implementation, a system (199) may be disposed at or communicate with the wellsite (100). System (199) may control at least a portion of a drilling operation at the wellsite (100) by providing controls to various components of the drilling operation. In one or more embodiments, system (199) may receive data from one or more sensors (160) arranged to measure controllable parameters of the drilling operation. As a nonlimiting example, sensors (160) may be arranged to measure gasses such as hydrocarbons or $H_2S$ at the drilling floor (131), hydrocarbons or $H_2S$ at the mud pit (132), WOB (weight on bit), RPM (drill string rotational speed), GPM (flow rate of the mud pumps), and ROP (rate of penetration of the drilling operation).

Sensors (160) may be positioned to measure parameter(s) related to the rotation of the drill string (108), parameter(s) related to travel of the traveling block (122), which may be used to determine ROP of the drilling operation, and parameter(s) related to flow rate of the pump (134). For illustration purposes, sensors (160) are shown on drill string (108) and proximate mud pump (134). The illustrated locations of sensors (160) are not intended to be limiting, and sensors (160) could be disposed wherever drilling parameters need to be measured. Moreover, there may be many more sensors (160) than shown in FIG. 1 to measure various other parameters of the drilling operation. Each sensor (160) may be configured to measure a desired physical stimulus.

During a drilling operation at the wellsite (100), the drill string (108) is rotated relative to the wellbore (102), and weight is applied to the drill bit (112) to enable the drill bit (112) to break rock as the drill string (108) is rotated. In some cases, the drill bit (112) may be rotated independently with a drilling motor. In further embodiments, the drill bit (112) may be rotated using a combination of the drilling motor and the top drive (130) (or a rotary swivel if a rotary table is used instead of a top drive to rotate the drill string (108)). While cutting rock with the drill bit (112), mud is pumped into the drill string (108).

The mud flows down the drill string (108) and exits into the bottom of the wellbore (102) through nozzles in the drill bit (112). The mud in the wellbore (102) then flows back up to the surface in an annular space between the drill string (108) and the wellbore (102) with entrained cuttings. The mud with the cuttings is returned to the pit (132) to be circulated back again into the drill string (108). Typically, the cuttings are removed from the mud, and the mud is reconditioned as necessary, before pumping the mud again into the drill string (108). In one or more embodiments, the drilling operation may be controlled by the system (199).

The downhole portion of the wellsite (100) (downhole portion being anywhere beneath the surface of the earth) is called the well herein.

While drilling the wellbore (102), as described above using a conventional drilling rig, fluid is pumped down a string of connected pipes (the drill string) and out of a drill bit (112) at the end. The fluid or drilling mud is then circulated back out of the hole to surface and the pieces of drilled rock cuttings are removed. The weight of the drilling mud is carefully controlled to provide a hydrostatic pressure on the formation that is designed—in most cases—to exceed the pressure of the fluids (water, hydrocarbons) contained in the drilled rock. In this way those fluids are prevented from entering the annulus and being transported to surface. Sometimes due to complicated pressure regimes within the Earth's subsurface or due to the particular type of formation being drilled, the pressure exerted by the drilling mud can overcome by the formation pressure and as a result the formation fluids can start to enter the well and are circulated back to surface.

Drilling rig equipment can deal with certain levels of entrained gas, and this is removed from the mud by degassers. In other situations, formation gases including $H_2S$ which have precipitated out of solution can be unintentionally released into the atmosphere—often called a blowout. Natural Gas is mostly comprised of methane and has a density of 0.657 kg/m$^3$, which is lighter than that of air at 1.2 kg/m$^3$. $H_2S$ however can also be present in many wells, and it has a density of 1.36 kg/m$^3$. The lighter gases will rise into the atmosphere and be dispersed by wind whereas the $H_2S$ will sink to the ground and become a danger to life.

$H_2S$ is poisonous, corrosive, and flammable. Exposure to concentrations over 1000 ppm can lead to instant death and concentrations as low as of 320 ppm are also life-threatening. It is, therefore, very important to contain the gas and $H_2S$ release at the wellsite and prevent it from reaching people. At concentrations of 4.3% to 45% by volume (43,000 to 450,000 ppm) the $H_2S$ is flammable and can be burnt off.

Ignition of the $H_2S$ gas prevents concentrations of $H_2S$ from reaching toxic levels. Accordingly, there is a need to ignite the $H_2S$ safely. An ignition source is maintained on site to ignite the $H_2S$ safely. In the event of a gas release the available igniters spray a burning gel liquid over the drilling rig in order to ignite it. The igniter-gel systems can be operated remotely, and the gel remains alight after landing providing re-ignition if the blowout fire self-extinguishes. The gel is a fire and safety hazard for storage and for transport, and the system has a limited use life. Upon being activated it will fire every two minutes for a total of twenty times (coinciding with the gel reservoir or compressed air tanks being consumed) providing approximately forty minutes of operation for allowing personnel to evacuate the area.

Another method is for a person to fire a flare gun while standing near enough to the blowout to effect an accurate shot. If the flare or the fire self-extinguishes, a subsequent flare must be fired again. As such, embodiments disclosed herein present systems and methods for a spark plume generator (SPG) that is able to ignite well blowouts for a much longer activation period, that does not contain any flammable chemicals, and that can be readily function tested at the wellsite as part of regular safety drills.

The method of heat generation is by grinding to create sparks. A grinding wheel or plurality of grinding wheels (grinder) made of abrasive material such as aluminum oxide, silicon carbide, ceramic, diamond, and cubic boron nitride are rotated at high RPM against a metallic cylinder such as iron, titanium, or other suitable material. To ensure the maximum life of the system the metallic cylinder (igniter) may also rotate in the opposite direction to the grinder and may traverse from side to side.

During actuation both the grinder and the metallic cylinder material will reduce in OD. A compensation system is included to maintain activation force between the two surfaces to maintain a consistent spark plume and optimize run life.

In accordance with one or more embodiments a backup grinding wheel or a plurality of backup grinding wheels with an initial OD smaller than the grinder or plurality of grinders may also be disposed on the SPG. In accordance with one or more embodiments the backup grinding wheel may be mounted on a rotatable grinder axle. The backup grinding wheel engages the igniter at a time selected to provide best performance from the SPG. In one or more embodiments, the backup grinding wheel engages the igniter when the abrasive grinder surface wears down (is consumed) to the approximate diameter of the backup grinding wheel. Thus, at that point, the grinding wheel causes the igniter to create sparks.

Once activated the device can be operated as required either on an intermittent basis or continuously until the grinding wheels, metallic cylinder, compressed air, or batteries are consumed.

Figure 2:
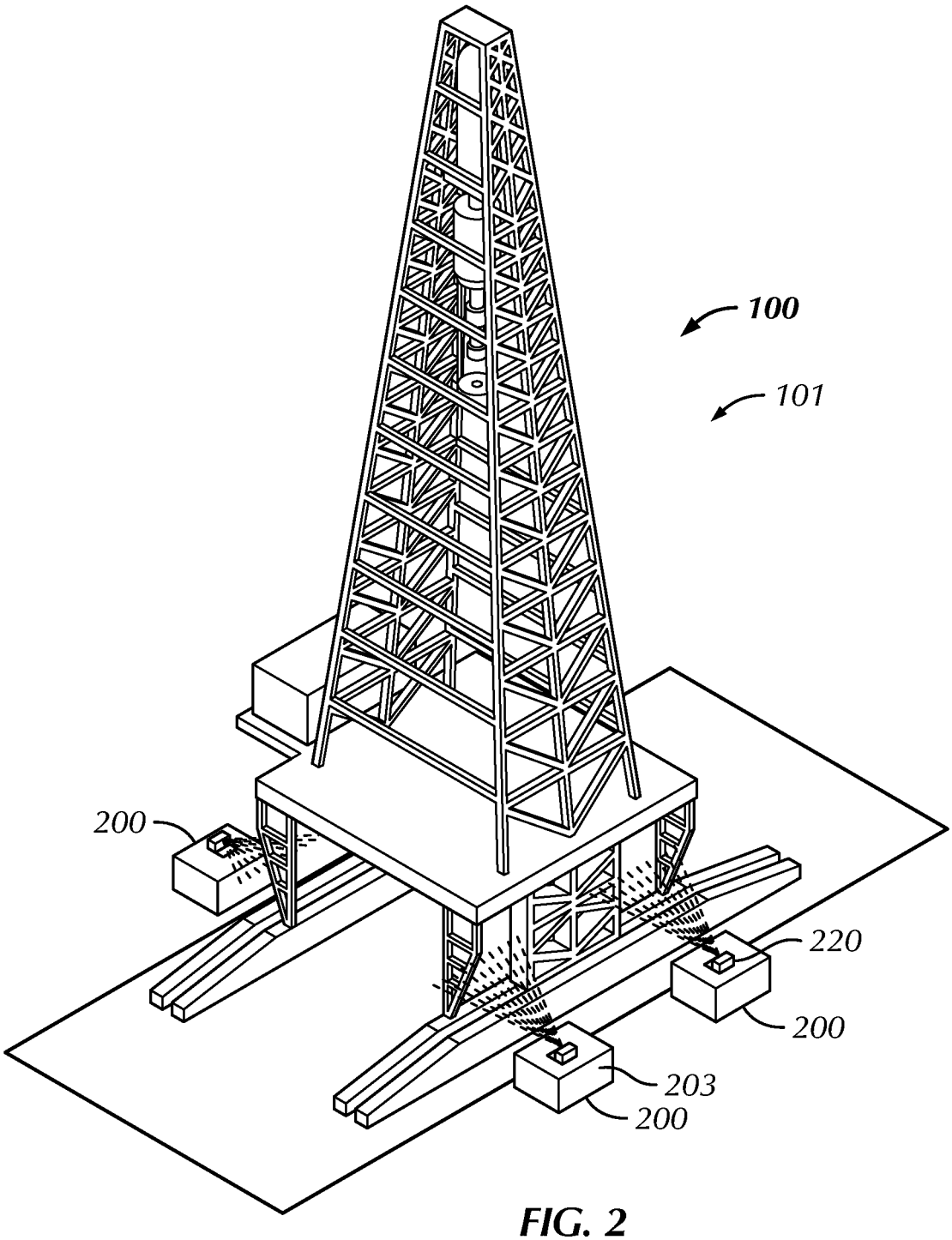
FIG. 2 shows a plurality f the invention disposed about a wellsite in accordance with one or more embodiments.

FIG. 2 shows the SPG (200) in accordance with one or more embodiments. The SPG (200) or a plurality of SPCs are located at the wellsite (100) and stationed around and proximate to the drilling rig (101). The SPGs have a fireproof housing (203) with an opening (220) and the fireproof housing (203) is positioned such that the opening (220) is facing the drilling rig (101). The SPGs are normally dormant until activated. Upon activation of the SPG (200), each provides an ignition source for the $H_2S$.

Figure 3:
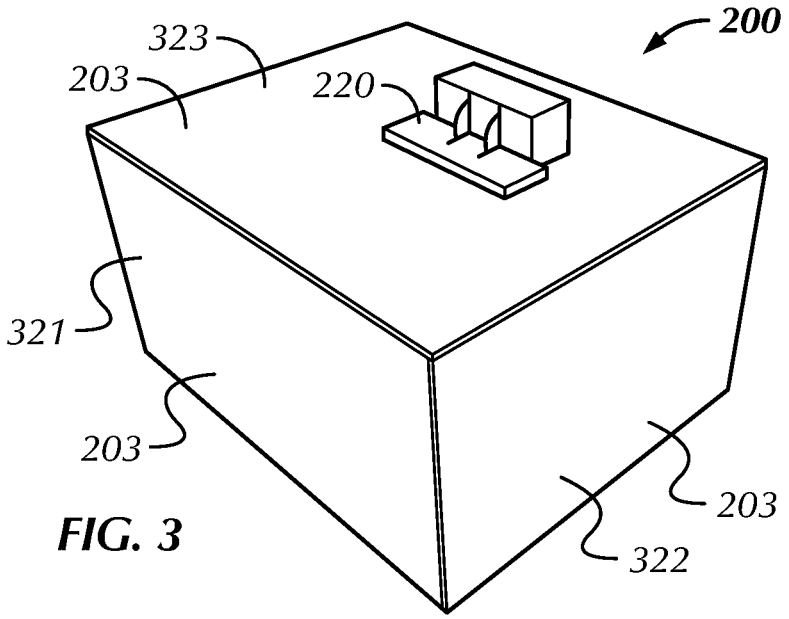
FIG. 3 shows an external view in accordance with one or more embodiments.

FIG. 3 shows an external view of the SPG (200) and an SPG fireproof housing (203) with orientations for an SPG front (321), an SPG left (322), and an SPG top (323). FIG. 3 also shows the opening (220) in the fireproof housing (203).

Figure 4A:
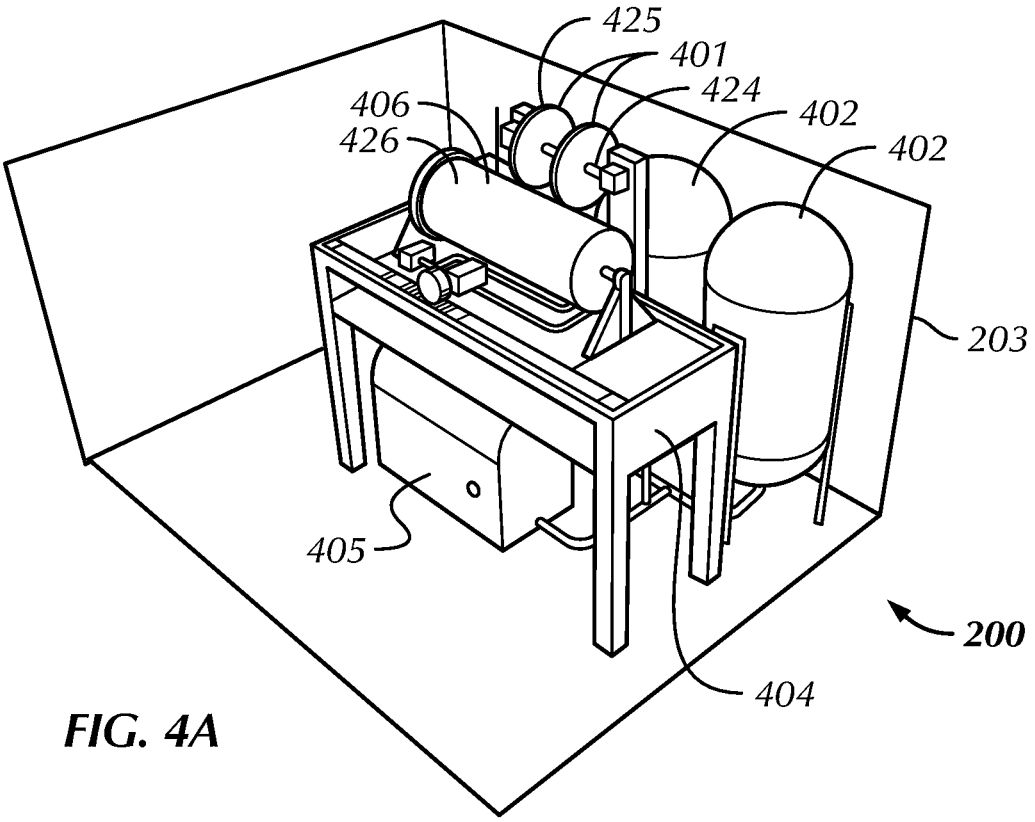
FIG. 4A shows an interior view in accordance with one or more embodiments.

FIG. 4A shows the interior view of the SPG (200) in accordance with one or more embodiments comprising at least one grinder (401) mounted on a support (404) and comprising the rotatable axle (424) with an abrasive grinder surface (425) within the fireproof housing (203). FIG. 4A also shows an igniter (406) mounted on the support (404) so as to cooperatively contact the grinder (401). The igniter (406) comprises an igniter surface (426) that creates sparks when abraded. FIG. 4A shows the support (404) positioned within the fireproof housing (203) so that sparks created by the igniter surface (426) exit the fireproof housing (203) through the opening (220). FIG. 4A also shows a pneumatic compressor (405). In accordance with one or more embodiments, the system may comprise at least one compressed air storage tank (402).

Figure 4B:
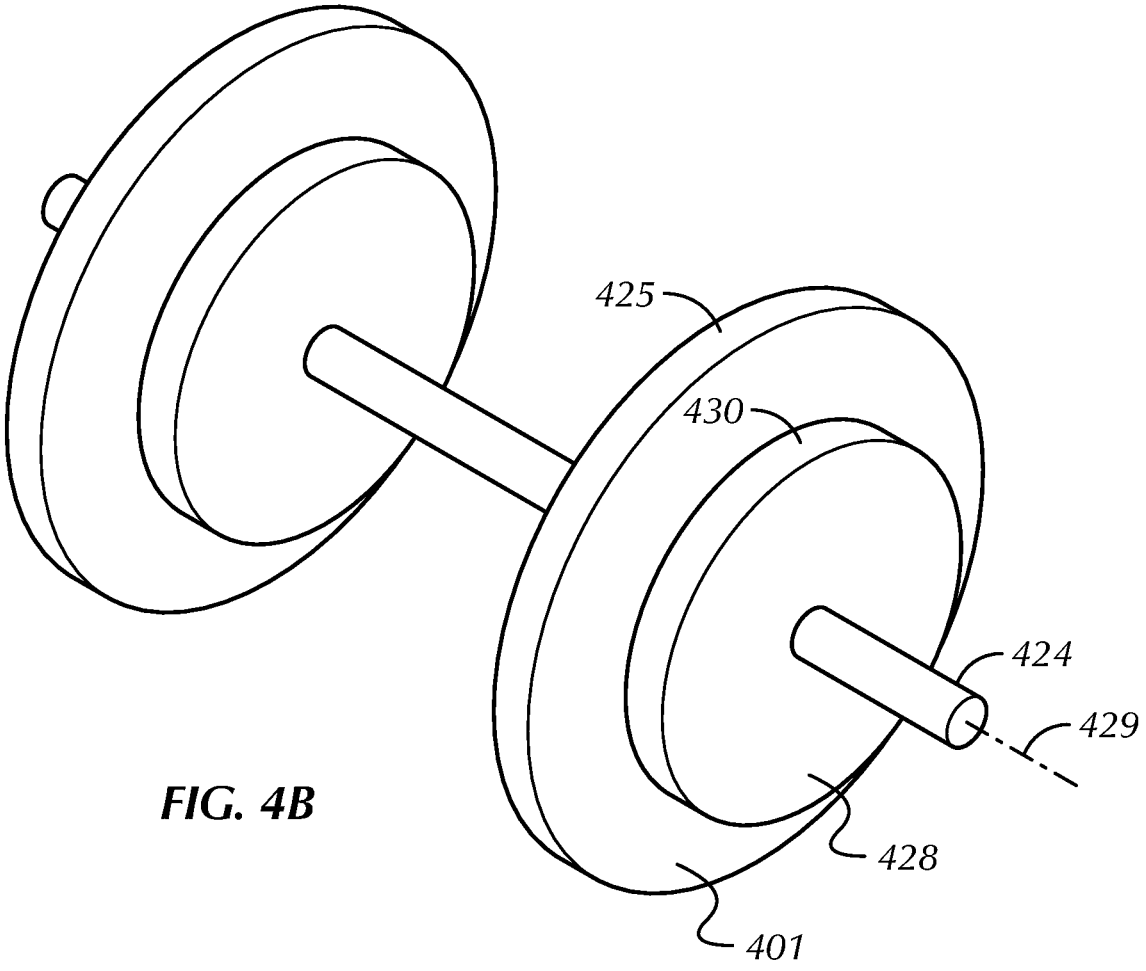
FIG. 4B shows two grinders and two backup grinding wheels in accordance with one or more embodiments.

FIG. 4B shows, in accordance with one or more embodiments, a pair of grinders (401) mounted on a rotatable axle (424) with an abrasive grinder surface (425). In the embodiment shown, the two grinders (401) are accompanied by two backup grinding wheels (428) also mounted on the rotatable grinder axle (424). The backup grinding wheels (428) have a diameter that is smaller than a diameter of the grinders (401). As described previously with respect to FIG. 4A, the igniter (406) creates sparks that exit the fireproof housing (203) through the opening (220) when abraded by the grinders (401). In the embodiment shown in FIG. 4B, when the abrasion of grinders (401) results in the diameter of the grinders (401) reaching the same or less diameter as the diameter of grinding wheels (428), the sparks will be created by the igniter surface (426) contacting the backup grinding wheels (428).

Figure 5:
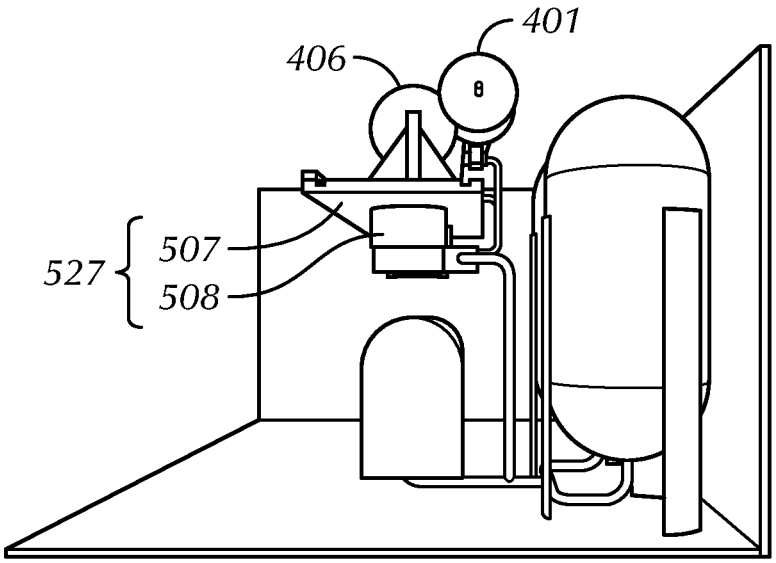
FIG. 5 shows a force compensation system in accordance with one or more embodiments.

FIG. 5 shows in accordance with one or more embodiments a force compensation system (527) for maintaining steady force between the grinder (401) and the igniter (406) as the grinder (401) and the igniter (406) are consumed during actuation. In accordance with one or more embodiments the force compensation system comprises a floating table (507) and a compensation piston (508).

Figure 6:
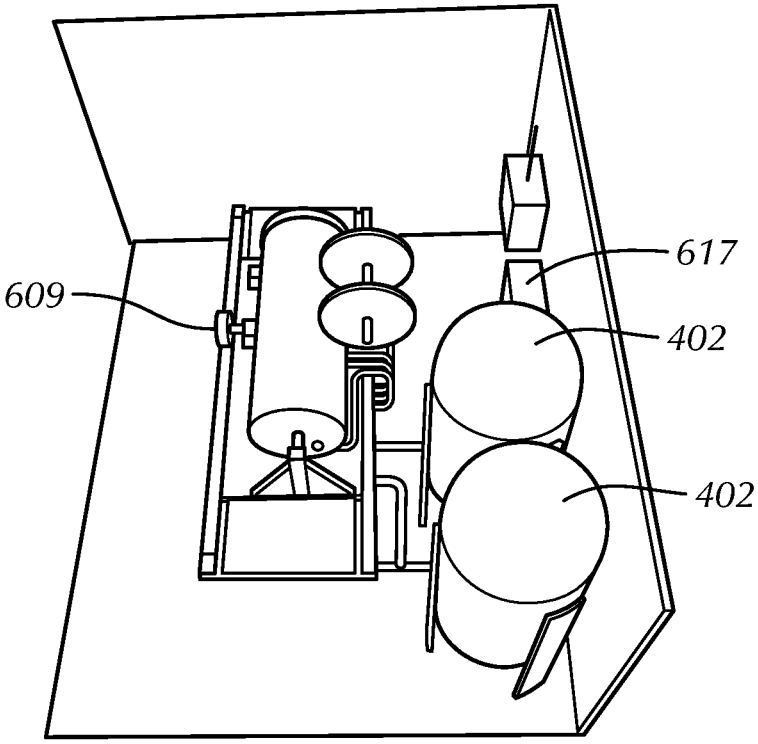
FIG. 6 shows an igniter transverse motion motor in accordance with one or more embodiments.
Figure 7:
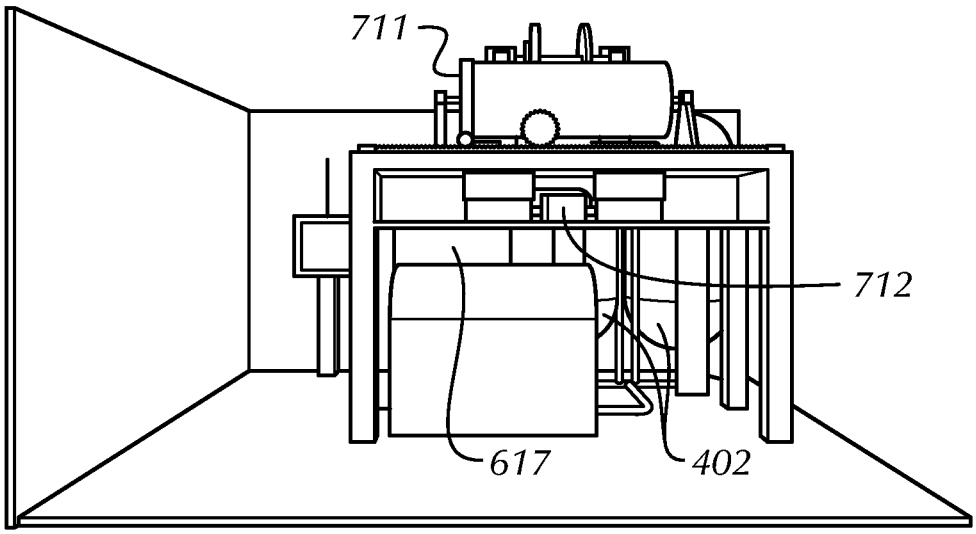
FIG. 7 shows an igniter rotation mechanism and a pneumatic control module in accordance with one or more embodiments.
Figure 8:
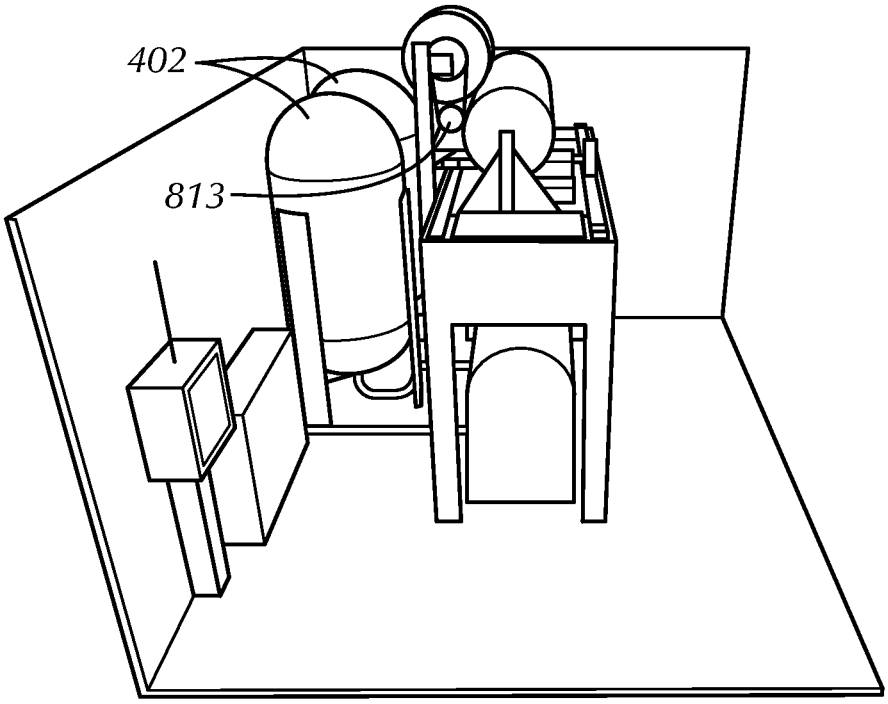
FIG. 8 shows a grinder rotation mechanism in accordance with one or more embodiments.

FIG. 6 shows an igniter translation device (609). In accordance with one or more embodiments the translation device may comprise a transverse motion motor. In accordance with one or more embodiments the translation device (609) may further comprise a traveling bed. FIG. 7 shows an igniter rotation mechanism (711). FIG. 8 shows a grinder rotation mechanism (813). In accordance with one or more embodiments the translation device, the traveling bed, the igniter rotation mechanism, and the grinder rotation mechanism may be powered by compressed air. The SPG may comprise the compressed air storage tanks (402) disposed to provide uninterrupted operation if the drilling rig air supply fails. In an alternative embodiment the translation device, the traveling bed, the igniter rotation mechanism, and the grinder rotation mechanism may be electrically powered with electric power supplied by the drilling rig and with battery electric power supplied by an uninterruptible power supply battery backup (617).

FIG. 7 shows the igniter rotation mechanism (711) and a pneumatic control module (712). In accordance with one or more embodiments the igniter rotation mechanism (711) may comprise an igniter rotation motor.

FIG. 8 shows the grinder rotation mechanism (813). The SPG generates a plume of hot (650-1200 degC depending on materials used) sparks that it can spray over a short distance towards the drilling rig. Gas is ignited by the plume of sparks.

Figure 9:
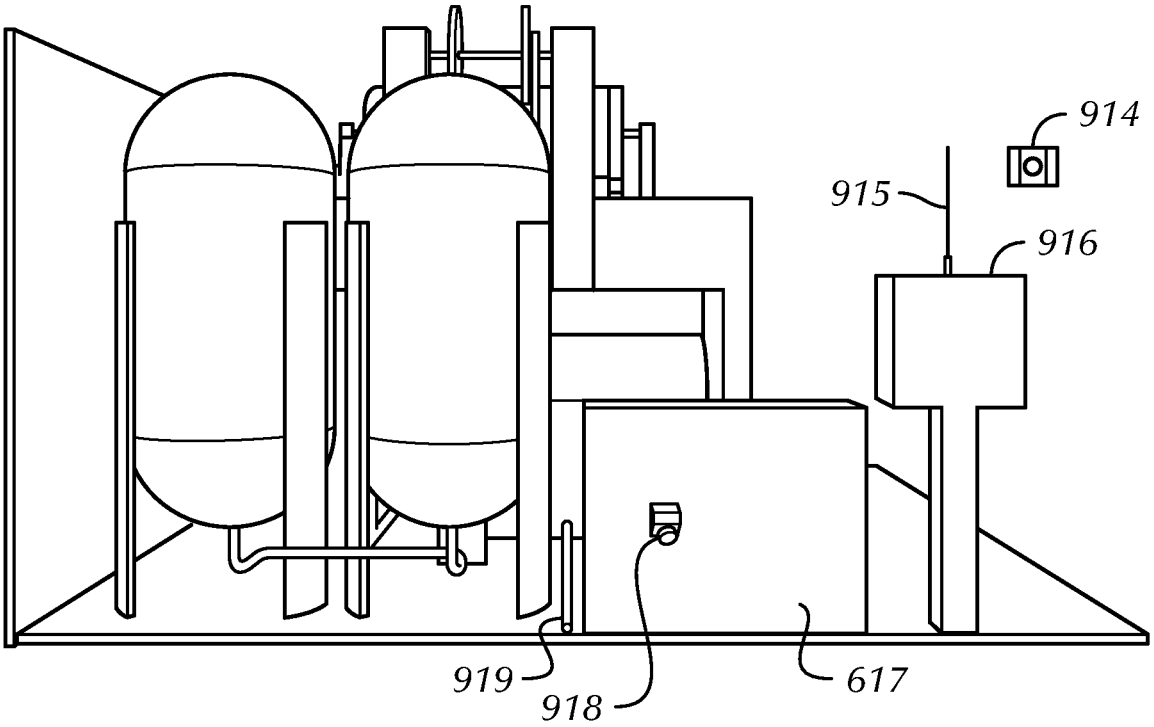
FIG. 9 shows control components in accordance with one or more embodiments.

Referring to FIG. 9, activation is by manual action, such as a manually operated switch (914) that may be located at an external location on the SPG or at other locations remote from the hazard such as upwind in the prevailing wind direction. Activation may also be via remote control such as a radio or other suitable method. FIG. 9 shows a remote activation receiver such as a radio antenna (915) for a radio. If more than one of the devices is in service, then each of the devices may be operated independently or a plurality of the devices may be operated simultaneously.

Also shown in FIG. 9, the SPG may normally be powered by utility feeds from the drilling rig (rig utilities), such as electrical (918), pneumatic (919), hydraulic, or any combination, with the uninterruptible power supply battery backup (617). The device comprises computer processing capability (916) to control the operation.

Figure 10:
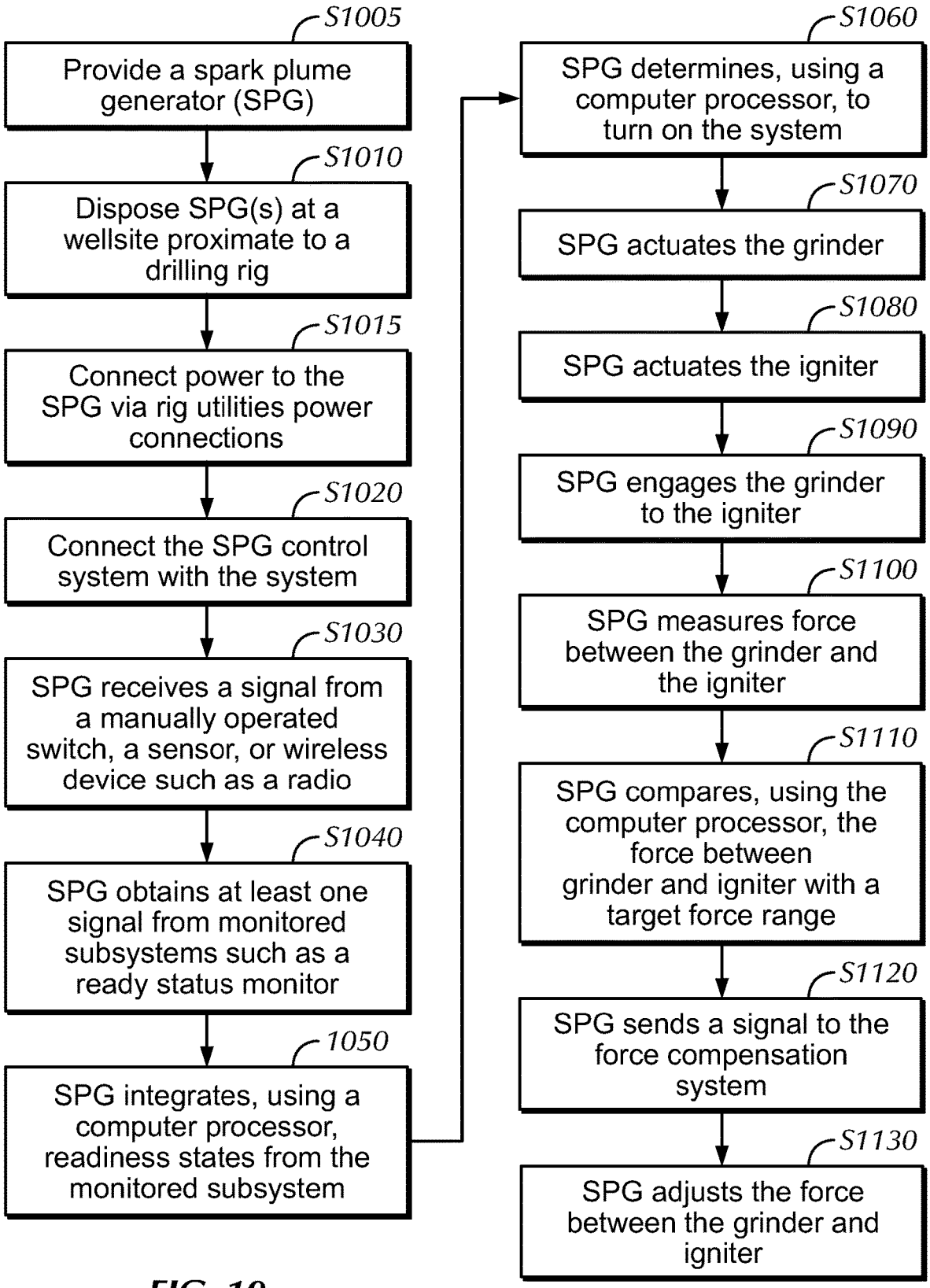
FIG. 10 shows a flowchart in accordance with one or more embodiments.

FIG. 10 depicts a flowchart in accordance with one or more embodiments. More specifically, FIG. 10 illustrates a method for igniting a poisonous gas flowing out of a well 102. Further, one or more blocks in FIG. 10 may be performed by one or more components as described in FIGS. 1-9. While the various blocks in FIG. 10 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a spark plume generator (SPG) (200) is provided (S1005). The SPG (200) or a plurality of SPGs is or are disposed at a wellsite (100) proximate to a drilling rig (101) (S1010). The power to the SPG (200) is connected via rig utilities power connections such as the drilling rig power socket (918) and the drilling rig pneumatic connection (919) (S1015). In accordance with one or more embodiments the SPG control system (916) is disposed at the wellsite.

In accordance with one or more embodiments the SPG control system (916) is connected with the system (199) (S1020). In accordance with one or more embodiments the SPG (200) receives a signal from a manually operated switch (914), or from a sensor (160), or from a wireless device such as a radio (S1030). The SPG obtains at least one signal from monitored subsystems (S1040) such as a ready status monitor. The SPG (200) integrates, using a computer processor, readiness states from the monitored subsystem (1050). The SPG (200) determines, using a computer processor, to turn on the system (S1060). The SPG (200) actuates the grinder (S1070). The SPG (200) actuates the igniter (S1080).

In accordance with one or more embodiments the SPG (200) engages the grinder (401) to the igniter (406) (S1090). The SPG (200) measures force between the grinder (401) and the igniter (406) (S1100). The SPG (200) compares, using the computer processor (916), the force between grinder (401) and igniter (406) with a target force range (S1110). The SPG (200) sends a signal to the force compensation system (527) (S1120). The SPG (200) adjusts the force between the grinder (401) and igniter (406) (S1130).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A spark plume generator system for igniting flammable gases at a drilling rig, the system comprising:

a support disposed within a fireproof housing proximate to the drilling rig;

a grinder mounted on the support, the grinder comprising a rotatable grinder axle with an abrasive grinder surface thereon;

an igniter mounted on the support so as to cooperatively contact the grinder, the igniter comprising an igniter surface that creates sparks when abraded, wherein the fireproof housing comprises an opening, wherein, upon rotation of the grinder axle, the grinder surface abrades the igniter surface to create sparks, wherein the support is positioned within the fireproof housing so that sparks created by the igniter surface exit the fireproof housing through the opening, and wherein the fireproof housing is positioned such that the opening is facing the drilling rig and sparks exiting the opening will ignite any flammable gases at the drilling rig.

2. The system of claim 1 further comprising;

a rotary power source configured to rotate the grinder.

3. The system of claim 1 further comprising;

a compensation system comprising a force device disposed on the support, and a table disposed on the force device, and a translation device disposed on the table and configured to translate the igniter.

4. The system of claim 3;

wherein the translation device moves the igniter in an X, or a Y, or a Z direction, or rotates the igniter about a longitudinal axis of the axle, or any combination thereof.

5. The system of claim 1 further comprising;

a frame wherein the frame comprises a frame top and a frame bottom, the support is mounted to the top of the frame bottom.

6. The system of claim 1 further comprising;

the grinder disposed proximate to and penetrating through the frame top.

7. The system of claim 1 further comprising;

a spark plume generator control system comprising a system control module, a pneumatic control module, a start-stop switch, a radio signal receiving antenna, and an uninterruptable power supply.

8. A method for reducing a concentration of $H_2S$ in air proximate a leak of $H_2S$ from subterranean reservoirs, the method comprising:

providing a spark plume generator (SPG) comprising:

a support disposed within a fireproof housing proximate to a drilling rig;

a grinder mounted on the support, the grinder comprising a rotatable grinder axle with an abrasive grinder surface thereon;

an igniter mounted on the support so as to cooperatively contact the grinder, the igniter comprising an igniter surface that creates sparks when abraded;

disposing an SPG at a wellsite proximate to the drilling rig;

connecting the SPG to the drilling rig; and
actuating the SPG.

9. The method of claim 8,
wherein the actuating the SPG further comprises signaling the SPG to actuate.

10. The method of claim 8,
wherein the SPG further comprises a spark plume generator control system.

11. The method of claim 10,
wherein the spark plume generator control system is disposed at the wellsite.

12. The method of claim 10,
wherein the spark plume generator control system is connected to the system.

13. The method of claim 10,
wherein the spark plume generator control system is connected to a remote-control system.

14. The method of claim 9,
wherein the signaling the spark plume generator to actuate is sent by the spark plume generator control system via the system or the remote-control system.

15. The method of claim 8,
wherein the SPG further comprises a monitored subsystem.

16. The method of claim 8,
wherein the actuating the SPG further comprises integrating, using a computer processor, readiness states from the monitored subsystem.

17. The method of claim 8,
wherein the actuating the SPG further comprises obtaining at least one signal from the monitored subsystem.

18. The method of claim 8,
wherein the actuating the SPG further comprises determining, using a computer processor, to actuate the SPG.

19. The method of claim 8,
wherein the actuating the SPG further comprises actuating the grinder.

20. The method of claim 8,
wherein the actuating the SPG further comprises actuating the igniter.

21. The method of claim 8,
wherein the actuating the SPG further comprises engaging the grinder to the igniter.

22. The method of claim 8,
wherein the support further comprises a force compensation system adjusting the force between the grinder and the igniter.

23. The method of claim 22,
wherein the adjusting the force between the grinder and the igniter is controlled by the SPG control system.

24. The method of claim 15,
wherein the monitored subsystem comprises a monitoring of the force between the grinder and the igniter.

25. The method of claim 24,
wherein the monitoring of the force between the grinder and the igniter is compared, using the computer processor, with a force range.

26. The method of claim 25,
wherein the comparing with a force range is determined by the SPG control system to obtain a force value to adjust the force to fall within the force range.

27. The method of claim 23,
wherein the adjusting the force between the grinder and the igniter is adjusted by the SPG control system signaling the force compensation system to obtain a force within the force range.

* * * * *